US006244723B1

(12) United States Patent
Talamo

(10) Patent No.: US 6,244,723 B1
(45) Date of Patent: Jun. 12, 2001

(54) LIGHTED WAND FOR USE AT NIGHT HAVING NOVEL LIGHT PATTERN

(76) Inventor: John Talamo, 1150 Peach St., Abilene, TX (US) 79602

( * ) Notice: Subject to any disclaimer, the term of this patent is extended or adjusted under 35 U.S.C. 154(b) by 0 days.

(21) Appl. No.: 09/480,034

(22) Filed: Jan. 10, 2000

(51) Int. Cl.[7] ..... F21L 4/00

(52) U.S. Cl. ..... 362/208; 362/157; 362/186; 362/244

(58) Field of Search ..... 362/109, 186, 362/202, 208, 209, 335, 340, 577, 244, 245, 247

(56) References Cited

U.S. PATENT DOCUMENTS 5,279,513 * 1/1994 Connelly ..... 446/219
6,086,218 * 7/2000 Robertson ..... 362/157

* cited by examiner

*Primary Examiner*—Sandra O'Shea
*Assistant Examiner*—Hargobind S. Sawhney
(74) *Attorney, Agent, or Firm*—Roy A. Ekstrand

(57) ABSTRACT

A elongated handle supports an electronic circuit and battery power source. A light transmissive conical body is secured to the handle and defines a plurality of lens elements for refracting light in an outwardly non-uniform pattern. A plurality of light emitting diodes are energized by the electronic circuit to direct flashing light into conical body.

15 Claims, 1 Drawing Sheet

LIGHTED WAND FOR USE AT NIGHT HAVING NOVEL LIGHT PATTERN

FIELD OF THE INVENTION

This invention relates generally to lighted safety and control devices for hand held use and particularly to the illumination devices utilized therein.

BACKGROUND OF THE INVENTION

In many different segments of the society a situation frequently arises in which one or more individuals seek to communicate with other individuals to guide or control the operation of machines, vehicles or the like utilizing the use of hand signals. During day light hours such signaling may be communicated using brightly colored flags or paddles or the like. Typical users of such hand held devices include police officers guiding traffic, airline ground crew members guiding aircraft on the ground, road construction workers taking care to route drivers past a potential hazard, and emergency personal at the scene of a vehicle accident. In most such situations the presently available brightly colored flags and paddles and the like may serve very well. However, in the darkness of night such brightly colored paddles and flags are often invisible in the absence of illumination from a vehicle or portable light source ect. Faced with this problem practitioners in the art have developed a variety of illuminated devises which are visible in the dark due to the creation of their own illumination and thereby their own enhanced visibility. While a variety of flashlights and battery powered lanterns have been used in such activities, perhaps the most common is provided by converting a basic flash light having a cylindrical body, a reflecting mirror and an energized light bulb together with a light transparent or translucent lens member secured to the flashlight. The translucent member is often shaped as a cylinder or may be conical. In some structures, a clear path through the outer end is provided to maintain some of the flashlight beam capability while the remainder is brightly colored and frosted to provide illumination of the cone itself.

In addition, many other persons not directly connected by occupation such as emergency workers, police or air ground crews nonetheless place one or more of such signaling devices within their vehicle to be used in the event a vehicle accident occurs and such devices are needed on an emergency basis. Not surprisingly the type used generally by such persons substantially mirrors the flashlight-like device described above.

As the design of conventional flashlights remains subject to several limitations of performance, so like wise does the design of such signaling units or wands. For example, a limited quantity of battery power is available within the device batteries and the design of the unit frequently attempts to balance the illumination power needed for effectiveness against the anticipated or required battery life. In the same manner, illuminated wands or other signaling devices must balance battery power and light output. In this aspect the effectiveness of the illuminated unit such as the opaque cone is an important criteria. Moreover, it is desirable the such units when used as lighted wands for communication and emergency purposes be sufficiently visible against varying backgrounds that attention thereto may be assured during use. Finally, the existing problems of reliability which includes use in rain and other potentially damaging weather is ever present.

Generally speaking, it is a fact of life that brighter illumination proves to be more eye catching and visible but does so at the expense of battery life. Conversely attempts to extend battery life generally result in a reduction of visibility and eye catching quality.

In addition to the brightness-power consideration, conventional devises may have difficulty attention in an environment such as a vehicle collision in which large numbers of colored lights ect. are present. This aspect of getting the attention of a vehicle driver or other person in the mist of such colored light scene is an important aspect in providing an improved lighted wand for use at night.

There remains therefore, a continuing need in the art for evermore improved lighted wands suitable for use in a dark or night time environment.

SUMMARY OF THE INVENTION

Accordingly, it is a general object of the present invention to provide an improved lighted wand for use at night. It is a more particular object of the present invention to provided wand for use at night having a novel light pattern. It is a still more particular object of the present invention to provide an improved lighted wand for use at night having a novel light pattern and enhanced capability for catching the attention of a vehicle driver or the like while in the mist of a multiple color lighted scene.

In accidence with the present invention there is provided a lighted wand comprising: an elongated handle having a closed end, an open end and a handle interior; a generally conical body having a maximum end secured to the open end of the handle, a lens cone tapered to a smaller dimension and a closed end, the conical body defining a cone interior; a reflector supported within the handle interior having a plurality of light emitting diodes supported to reflect light into the cone interior; circuit means and battery means supported within the handle interior for applying electrical pulses to the light emitting diodes; and a plurality of elongated lens elements formed upon the lens cone within the cone interior, the elongated lens elements refracting light through the lens cone in a non-uniform pattern.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 2, 3, 4, 5:
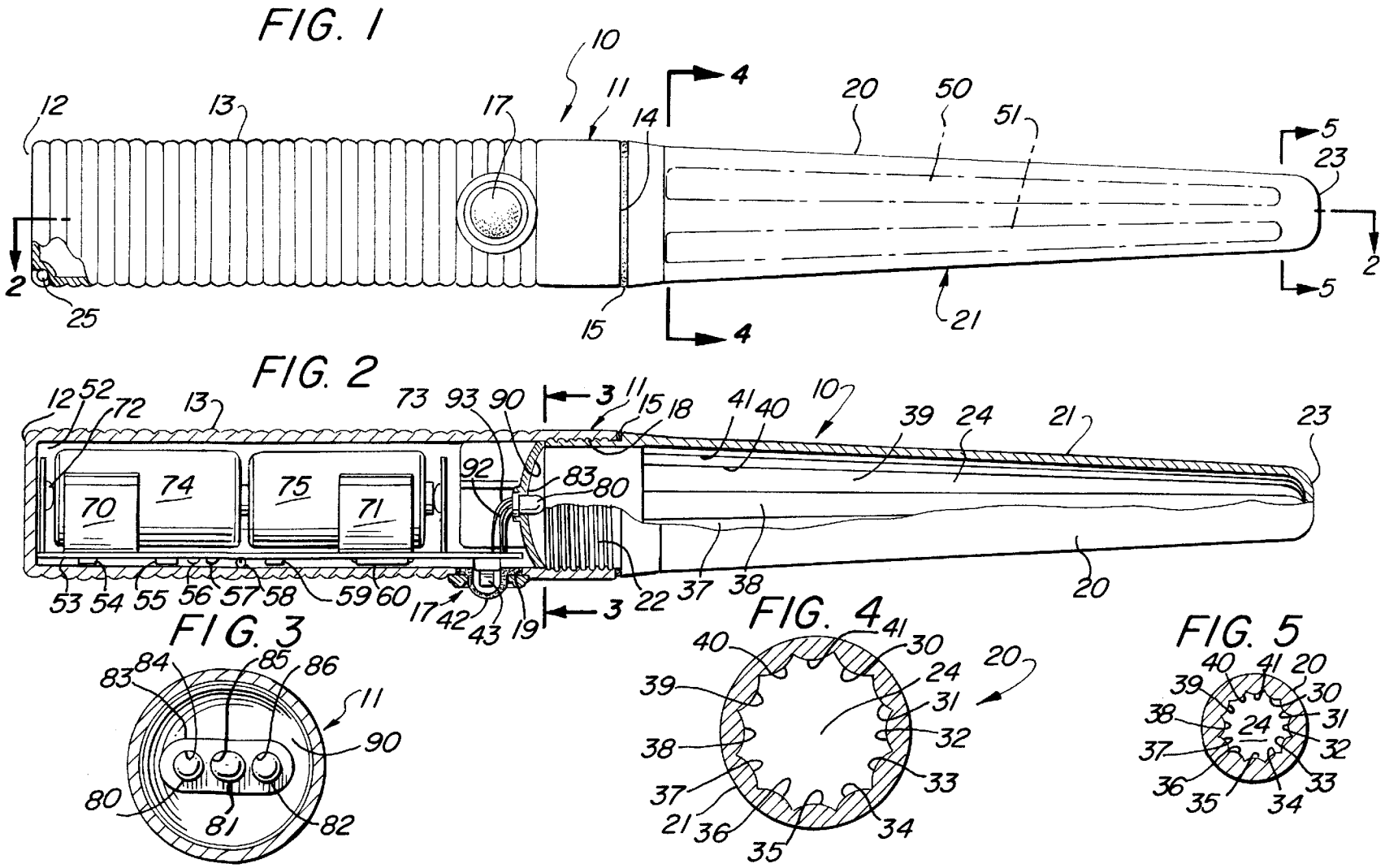
FIG. 1 sets forth a partially sectioned top view of a lighted wand constructed in accordance with the present invention.
FIG. 2 sets forth a section view of the present invention lighted wand taken along section lines 2—2 in FIG. 1.
FIG. 3 sets forth a section view of the present invention lighted wand taken along section lines 3—3 in FIG. 2.
FIG. 4 sets forth a section view of the present invention lighted wand taken along section lines 4—4 in FIG. 1.
FIG. 5 sets forth a section view of the present invention lighted wand taken along section lines 5—5 in FIG. 1.

FIG. 1 sets forth a partially sectioned top view of a lighted wand constructed in accordance with the present invention and generally referenced by numeral 10. Lighted wand 10 includes an elongated generally cylindrical handle 11 having an end 12 formed therein. End 12 further includes an aperture ring 25. Handle 11 further includes a plurality of internal threads 18 (seen in FIG. 2). A plurality of ridges 13 is formed upon the majority of handle 11 and is operative to improve the hand gripping characteristics of handle 11. A button 17 is supported upon handle 11 in the manner indicated below in FIG. 2 in greater detail. Suffice it to note here that button 17 is formed of a resilient material such as molded plastic or rubber or the like and is secured to handle 11 to facilitate a water proof seal protecting internal components of lighted wand 10 such as those shown in FIG. 2.

Lighted wand 10 further includes a conical body 21 formed of a light transmissive material such as clear or transparent molded plastic material. Conical body 21 includes a generally rounded end 23 and a threaded end 22 (seen in FIG. 2). The structure of threaded end 22 and its cooperation with threads 18 of handle 11 is described below in FIG. 2 in greater detail. However, suffice it to note here that such threaded cooperating members facilitate the attachment of conical body 21 to output end 14 of handle 11 in a manner which facilitates captivating a resilient seal 15 therebetween. Seal 15 is formed of a resilient material and may for example comprise a conventional O-ring seal which is compressed as conical body 21 is threaded into handle 11.

Conical body is formed of a frusto-conical lens cone 20 having an open end coupled to treaded end 22 (seen in FIG. 2) and extending therefrom with reducing diameter to end 23 of conical body 21.

In the preferred fabrication of the present invention conical body 21 and particularly lens cone 20 are formed of a light transmissive material. By way of further preference lens cone 20 is fabricated of a transparent material having a tint or color filter characteristic which colors the light passing therethrough. End 23 may be clear to provide a second optical characteristic if desired this however, is optional and not essential for the present invention. In accordance with an alternate configuration with lens cone 20, a plurality of elongated opaque areas such as opaque areas 50 and 51 shown in dash line representation upon the outer surface of lens cone 20 may be utilized to further augment the optical characteristic. However, it will be apparent to those skilled in the art from the descriptions which follow that opaque areas such as areas 50 and 51 may be omitted from the present invention and therefore are appropriately shown in Dash-line representation.

In operation by means set forth below in greater detail, the activation of button 17 by pushing button 17 into handle 11 activates a battery powered electronic circuit which is of conventional fabrication and which provides a plurality of signal pulses to a trio of light emitting diodes (light emitting diodes 80, 81 and 82 seen in FIG. 3). In further accordance with the operation of the present invention the light outputs of light emitting diodes 80–82 together with a reflector 90 (seen in FIG. 2) direct pulses of light energy into the interior of lens cone 20. In accordance with an important aspect of the present invention set forth below in greater detail, light originating within wand 10 and permeating outwardly through lens cone 20 is optically refracted by a plurality of internal slightly tapered cylindrical lens elements (see FIG. 4). The operation of such lens elements is described below in greater detail. However, suffice it to note here that the refracting characteristic of the cylindrical lens elements produces a unique light output pattern not provided heretofor by conventional signaling devices. In the event opaque areas 50 and 51 are utilized, this optional characteristic further alters the light output transmission characteristics of lens cones 20. It will be noted that the entire assembly of lighted wand 10 is for the most part formed of molded plastic material and is fabricated utilizing seal 15 and button 17 in a manner that maintains a water proof interior for lighted wand 10. As a result, lighted wand 10 may be utilized in a variety of environments including rain and other potentially damaging environments.

Ring aperture 25 formed at end 12 of handle 11 facilitates the attachment of a carrying band or the like that may for example comprise a ring of flexible cloth material formed in a closed loop and suitable in size for wearing upon the users wrist. Alternatively, aperture 25 may receive a larger ring and may be adapted to clipping lighted wand 10 to the users belt and so on.

FIG. 2 sets forth a section view of lighted wand 10 taken along section lines 2—2 in FIG. 1. As described above, lighted wand 10 includes an elongated generally cylindrical handle 11 having a plurality of ridges 13 and a closed end 12 formed therein. Handle 11 further defines a plurality of internal threads 18 at the open end thereof. Handle 11 further defines an aperture 19 which receives a resilient button cover 42 in a Snap-fit attachment. Resilient button cover 42 may be Snap-fitted or alternatively secured using a conventional adhesive-sealant or other suitable material. The important aspect of resilient button cover 42 is the provision of a flexible member supporting a resilient button 17 which may be deformed when pressed to activate a button switch 43 supported within aperture 19.

Lighted wand 10 includes a conical body 21 having a frusto-conical lens cone 20, a closed end 23 and a threaded end 22 formed therein. Conical body 21 defines an interior cavity 24 which is closed at end 23 and which is open at threaded end 22. As described above, conical body 21 is preferably formed of a transparent material such as molded plastic or the like. In its preferred fabrication conical body 21 is tinted to impart a characteristic color to light emanating from lens cone 20. In accordance with an important aspect of the present invention and is better seen in FIGS. 4 and 5 lens cone 20 further defines a plurality of elongated cylindrical lens such as lens 41–37 shown in FIG. 2. While such lens are described herein as generally cylindrical, it will be apparent to those skilled in the art that lens 30–41 (seen in FIG. 4) are in essence tapered in correspondence to the tapered structure of lens cone 20. Thus the term cylindrical as used herein is intended to describe the refracted characteristic of the lens in which a cylindrical lens characteristic is present at each cross sectional portion of lens cone 20.

Lighted wand 10 further includes a pair of battery supports 70 and 71 secured to a printed circuit board 53 using conventional fabricational techniques (not shown). Circuit board 53 is fabricated in accordance with conventional fabrication techniques and includes a plurality of electronic circuit components 54, 55, 56, 57, 58 and 59. The fabrication of the electronic circuit supported upon circuit board 53 is entirely conventional and operates to provide output power pulses to light emitting diodes 80–82 (seen in FIG. 3) when button 17 has been pushed activating button switch 43. Thus in the preferred fabrication of the present invention circuit element 60 comprises a conventional light emitting diodes driver having three outputs coupled to light emitting 80, 81 and 82 (seen in FIG. 3) via coupling wires 91, 92 and 93. As mentioned above, the circuit formed on circuit board 53 is fabricated entirely in accordance with conventional fabrication techniques with the essential operational characteristic thereof being the provision of a plurality of electrical signal pulses to light emitting diodes 80–82. In further accordance with conventional fabrication techniques circuit board 53 supports a pair of contacts 72 and 73 which couple the energy of a pair batteries 74 and 75 to operate the electronic circuit of circuit board 53.

Handle 11 further defines interior threads 18 which receive threaded end 22 of conical body 21 captivating a resilient seal 15 therebetween. In addition, a reflector 90 having a light emitting diodes socket 83 is secured within the interior of handle 11 and maintained by the extension of treaded end 22.

In operation the activation of button switch 43 by pressing resilient button cover 42 inwardly activates the electronic circuit means of circuit board 53 causing a plurality of pulse signals to be applied to the light emitting diodes via coupling wires 91–93. The resulting light output passes through the interior of threaded end 22 into interior cavity 24. Within interior cavity 24 and in accordance with an important aspect of the present invention, light is reflected by a plurality of cylindrical-type lens formed therein. As mentioned above, the lens elements within the interior of lens cone 20 are not precisely cylindrical but rather are tapered having progressively smaller size toward end 23. The important aspect with respect to the present invention, is the function of such plurality of lens elements to provide a characteristic which refracts the light outwardly from lens cone 20 in a non-uniform manner. Preferably this non-uniform manner corresponds to a generally focused strip-like light pattern due to the placement and orientation of the cylindrical lens elements.

FIG. 3 sets forth a section view of lighted wand 10 taken along section lines 3—3 in FIG. 2. Lighted wand 10 includes a generally cylindrical handle 11 supporting a reflector 90 which in turn supports a light emitting diodes socket 83. Socket 83 defines a plurality of apertures 84, 85 and 86 within which a corresponding plurality of light emitting diodes 80, 81 and 82 are supported. Light emitting diodes 80–82 are conventional in fabrication and in accordance with designer preference are selected to provide a desired light output hue. The important characteristic of light emitting diodes 80–82 is the conversion of electrical energy applied thereto into visible light.

FIG. 4 sets forth a section view of conical body 21 taken along section lines 4—4 in FIG. 1. A frusto-conical lens cone 20 defines an interior cavity 24 and in accordance with the present invention defines a plurality of cylindrical lens elements 30–41 generally equally spaced about the interior of lens cone 20. Thus as mentioned above, lens cone 20 is formed of a light transmissive material such as clear or tinted transparent material utilizing molded plastic or the like, which allows each of lens elements 30–41 to refract light impinging the element surfaces to provide a non-uniform optical light outwardly through lens cone 20. As a result, the light output of lens cone 20 is preferably formed into radially extending higher intensity focused portions. In addition, in the preferred fabrication of the present invention, light emitting diodes 80–82 (seen in FIG. 3) are operated in response to pulse type signals which combine with the lens elements within lens cone 20 to produce a novel flashing non-uniform light output.

FIG. 5 sets forth a section view of lens cone 20 taken along section lines 5—5. As can be seen, lens cone 20 defines a smaller diameter near end 23 due to the conical taper lens cone 20. Correspondingly, lens elements 30–41 formed within the interior of lens cone 20 are cylindrically shaped but substantially smaller than they are at the maximum dimension of lens cone 20. Interior cavity 24 is correspondingly reduced in size.

What has been shown is a novel lighted wand having a unique multiple lens cone which is energized by a light flashing circuit supported within the wand handle. The lens cone defines a plurality of slightly tapered cylindrical type lens elements which refract the light into a unique light pattern which is further augmented by the flashing operation of the light source. The handle and conical body supporting the lens cone are fabricated of low cost mass produceable molded plastic material or the like. While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A lighted wand comprising:

an elongated handle having a closed end, an open end and a handle interior;

a generally conical body having a maximum end secured to said open end of said handle, a lens cone tapered to a smaller dimension and a closed end, said conical body defining a cone interior;

a reflector supported within said handle interior having a plurality of light emitting diodes supported to reflect light into said cone interior;

circuit means and battery means supported within said handle interior for applying electrical pulses to said light emitting diodes; and a plurality of elongated lens elements formed upon said lens cone within said cone interior, said elongated lens elements refracting light through said lens cone in a non-uniform pattern.

2. The lighted wand set forth in claim 1 wherein said maximum end of said conical body defines an external thread and wherein said open end of said handle defines a cooperating internal thread receiving said external thread.

3. The lighted wand set forth in claim 2 further including a resilient annular seal interposed between said conical body and said elongated handle.

4. The lighted wand set forth in claim 1 wherein said elongated lens elements each defines arcuate cross-sections.

5. The lighted wand set forth in claim 4 wherein said elongated lens elements are each tapered from near said maximum end to smaller size near said closed end of said conical body.

6. The lighted wand set forth in claim 5 wherein said lens cone defines a cross-section having a circular outer surface.

7. The lighted wand set forth in claim 6 wherein said handle further includes an on-off pushbutton having an aperture formed in said handle, a resilient body sealing said aperture and a pushbutton switch operating said circuit means.

8. The lighted wand set forth in claim 1 wherein said elongated handle defines a plurality of ridges generally encircling said handle.

9. The lighted wand set forth in claim 8 wherein said conical body includes a plurality of opaque areas formed on said lens cone.

10. The lighted wand set forth in claim 1 wherein said elongated lens elements each defines arcuate cross-sections.

11. The lighted wand set forth in claim 10 wherein said elongated lens elements are each tapered from near said maximum end to smaller size near said closed end of said conical.

12. The lighted wand set forth in claim 11 wherein said lens cone defines a cross-section having a circular outer surface.

13. The lighted wand set forth in claim 12 wherein said handle further includes an on-off pushbutton having an aperture formed in said handle, a resilient body sealing said aperture and a pushbutton switch operating said circuit means.

14. The lighted wand set forth in claim 13 wherein said elongated handle defines a plurality of ridges generally encircling said handle.

15. The lighted wand set forth in claim 1 wherein said conical body includes a plurality of opaque areas formed on said lens cone.

* * * * *